US005925149A

United States Patent [19]

Pacifici et al.

[11] Patent Number: 5,925,149

[45] Date of Patent: Jul. 20, 1999

[54] METHOD FOR DYEING NYLON FABRICS IN MULTIPLE COLORS

[75] Inventors: Joseph A. Pacifici, Anderson; Daniel G. Sims, Greer, both of S.C.

[73] Assignee: Simco Holding Corporation, Greer, S.C.

[21] Appl. No.: 09/025,007

[22] Filed: Feb. 17, 1998

[51] Int. Cl.[6] ..... D06P 3/06; D06P 5/00; D06P 3/87

[52] U.S. Cl. ..... 8/481; 8/485; 8/557; 8/495

[58] Field of Search ..... 8/481, 485, 557, 8/495

[56] References Cited

U.S. PATENT DOCUMENTS

| | | | |
|---|---|---|---|
| 4,015,550 | 4/1977 | Bartenfeld et al. . | |
| 4,441,883 | 4/1984 | Vavala | 8/457 |
| 4,622,044 | 11/1986 | Nichols, Jr. | 8/485 |
| 4,883,839 | 11/1989 | Fitzgerald et al. | 525/136 |
| 5,030,245 | 7/1991 | Hemling et al. | 8/560 |
| 5,085,667 | 2/1992 | Jenkins | 8/539 |
| 5,152,803 | 10/1992 | Hangey et al. | 8/618 X |
| 5,199,958 | 4/1993 | Jenkins et al. | 8/539 |
| 5,350,426 | 9/1994 | Jenkins | 8/539 |
| 5,354,342 | 10/1994 | Jenkins | 8/481 X |
| 5,417,724 | 5/1995 | Pacifici et al. | 8/554 |
| 5,445,653 | 8/1995 | Hixson et al. | 8/531 |
| 5,466,527 | 11/1995 | Jenkins | 428/375 |
| 5,484,455 | 1/1996 | Kelley | 8/539 |
| 5,571,290 | 11/1996 | Jenkins | 8/485 |

OTHER PUBLICATIONS

Textile Fibers Department, Dyeing and Finishing of Du Pont Textile Nylon Bulletin N–259, pp. 13, 21 Sep. 1972, Du Pont Technical Information.

Beattie, I.B., et al, The Extraction and Classification of Dyes on Single Nylon, Polyacrylonitrile and Polyester Fibres pp. 295–296 JSDC Aug. 1979, Home Office Central Research.

Harris, Paul W., et al, Stain Resist Chemistry for Nylon 6 Carpet p. 25 Nov. 1989, Sac Synthesis.

Aspland, J.R., The Application of Ionic Dyes to Ionic Fibers: Nylon, Silk and Wool and Their Sorption of Anions vol. 25, No. 2, pp. 22–26 Feb. 1993, Textile Chemist and Colorist.

Aspland, J.R., The Application of Ionic Dyes to Ionic Fibers: Nylon, Silk and Wool and Their Sorption of Anions vol. 25, No. 3, pp. 55–59 Mar. 1993, Textile Chemist and Colorist.

Aspland, J.R., Anionic Dyes and Their Application to Ionic fibers: Dyeing Nylon with Acid Dyes vol. 25, No. 4, pp. 19–23 Apr. 1993, Textile Chemist and Colorist.

Kissa, Erik, Determination of Stain on Carpets vol. 27, No. 10, pp. 20–24 Oct. 1995, Textile Chemist and Colorist.

Rush, Lee J., Dyeing With Acid Dyes Dyeing Primer: Part 2, pp. 7–9 Textile Chemist and Colorist (Date Unknown).

*Primary Examiner*—Margaret Einsmann
*Assistant Examiner*—Brian Mruk
*Attorney, Agent, or Firm*—Kennedy, Davis & Kennedy, PC

[57] ABSTRACT

When nylon fibers are dyed with a first anionic dye and then treated with a stainblocker, they can be woven into a fabric with untreated nylon fibers and then subjected to a second dyeing process using a second anionic dye of a different color than the color of the first anionic dye, without risk of dye bleed or dye blending during the second dyeing operation.

7 Claims, No Drawings

METHOD FOR DYEING NYLON FABRICS IN MULTIPLE COLORS

TECHNICAL FIELD

The present invention relates to methods for dyeing woven, knit, and piled conventional nylon fabrics in multiple colors.

BACKGROUND OF THE INVENTION

During their manufacture, woven, knit, and piled conventional nylon fabrics undergo many types of dye processes to impart color for styling, aesthetics and other commercial requirements. Conventional nylon (anionic or acid dyeable) includes ordinary nylon 6 and nylon 66. As a result of industry tastes and individual preferences, the yarns in these fabrics are either dyed a single color, or two or more colors as part of a multicolored design.

If a fabric is dyed a single color, the fabric is likely to be dyed using either a batch or continuous dye method. Batch dyeing is a dyeing method that dyes a set amount of nylon, wool, or silk fabrics, yarns, or fiber stock as a single entity in an aqueous dye bath. The textiles are batch dyed in amounts up to 3–5 thousand pounds of goods, in 8–20 times that amount of water, which is referred to as the liquor ratio (water weight/fiber weight). Typically the chemicals found in a batch dye bath, aside from water, include anionic dyes, wetting agents, leveling agents and acid. The dyes may be either acid, direct, or fiber reactive and are typically present in an amount between 0.1 to 5.0% on weight of fiber (OWF), with 0.1% being for a light shade and 5.0% being for a dark shade.

The wetting agents in the bath are typically non-ionic surfactants for fast wetting and are present in an amount between 0.5 to 3.0% OWF. The leveling agents in the bath are typically cationic retarders for level dyeing and are present in an amount between 0.5 to 3.0% OWF. The acids in the bath are typically present in sufficient quantity to cause the pH of the bath to be between 7 and 3. Typically used acids include acetic acid, sulfamic acid, or MSP.

The liquor ratio of the dye bath is typically between 8 to 20, and the fibers are usually in the bath for 1 to 6 hours at a temperature of between 160 to 212° F.

Continuous dyeing, in contrast to batch dyeing, is a dyeing method that disperses dye from an applicator onto a moving continuous web of fibers. The speed at which the web travels past the applicator can run between a few feet per minute to 100 yards or more per minute. The widths of webs can be a few inches to several yards.

The shade of the continuous dyed textile depends on the amount of dye in solution coupled with the amount of solution deposited onto the fiber web. Solution weight is referred to as wet pick up (WPU), that is the ability of the fiber web to pick up solution. WPU is therefore expressed as a percentage of fiber weight. Typically, the chemicals used in a continuous dyeing operation include anionic dyes, wetting agents, thickeners and acids.

The continuous dye solution typically has a WPU of between 50% to 300%. The anionic dyes are typically present in the continuous dye solution in an amount between 1 g/l to 50 g/l, where 1 g/l is for a light shade and where 50 g/l is for a dark shade. The dyes can be acid, direct or fiber reactive.

The wetting agents are typically non-ionic surfactants for fast wetting and are present in the continuous dye solution in an amount between 0.5 g/l to 5.0 g/l.

The thickener is typically present in the continuous dye solution in an amount between 2 g/l to 10 g/l and are often guar gums to reduce dye migration. The acids are present in the solution in a sufficient quantity to create a pH of between 5 to 2, and may include acetic acid, sulfamic acid, or MSP. The continuous dye solution is applied and the dye fixed between 1 and 20 minutes at a steaming temperature.

The continuous dyeing method can also be used to create multiple color fabrics. When the continuous dyeing method is used to create multi-colored fabrics, the applicator has different heads, with each head dispersing a different color pigment. Once colors are applied to a fabric by this method, the fabric cannot undergo a second dyeing process to add colors, as the colors would likely bleed or blend. Furthermore, it would be difficult to match up the design pattern with the applicator when applying another color at a later time. Even when the continuous dye method is used to create multi-colored fabrics, there is not a high degree of detail in a multiple colored pattern produced from this dyeing process.

Multiple color dye effects can also be achieved by other techniques. For instance, with the dye techniques known as package dyeing and space dyeing, strands of yarn are first dyed solid and multiple color shades respectively. The strands are then woven, knitted or tufted into patterns to produce a multicolored design. For the purposes of this application, by "woven" is meant the incorporation of a fiber or yarn into a fabric, and encompassing piled, tufted, sewn and knitted. All of these dyeing techniques require mills to maintain a large inventory of colored yarns in order to provide a large selection of fabrics. The techniques necessarily limit the speed of production since the fabrics must be created from different colored yarns each time a different color scheme is selected.

Another commercial method for creating multiple colored patterns uses dyes which are only attracted to specific types of fibers (fiber selective dyes). Using this method fabrics are first woven with different types of undyed fibers. They are woven in a pattern so that when the fibers are dyed, the finished product has a multicolored pattern. The fabric is then dyed with fiber selective dyes to color the different fibers in the fabric. Unfortunately, this method is expensive and is limited to a narrow range of color shades. Moreover, manufacturers that employ this method must maintain a wide array of yarns in inventory in order to use a variety of colors.

While it would seem more efficient to sequentially dye fabrics with a series of colors, there are practical reasons why this is not commercially viable. For instance, previously dyed fabrics tend to bleed when subjected to the high temperature conditions of a second dyeing step. When the fabrics bleed, the ionic bonds which typically hold acid dyes to nylon are broken, thereby releasing the dye molecules. Previously dyed fabrics also absorb dye from a second dyeing process which changes the color shade. However, these problems have recently been partially overcome.

One solution has been to use anionic solution dyed nylon fibers. Dye pigment is entrained in these nylon fibers during production of the fibers themselves. As a result, the coloring in solution dyed nylon does not wash out or bleed under dyebath conditions. Advantageously, solution dyed nylon tends to be naturally resistant to further dyeing by most anionic acid dyes, and therefore also functions as a partial stainblocker. As a result, if solution dyed nylon fibers are interspersed with conventional undyed nylon fibers, and both are later exposed to an anionic dye, only the undyed nylon fibers are dyed. A problem with solution dyed nylon however, does remain in that it is only manufactured in a limited number of solid shades. Since maximum styling capability requires predyed yarns available in a wide variety of colors and shade depths, solution dyed nylon only offers a partial solution.

Other multiple color fabric processes are disclosed in U.S. Pat. No. 5,445,653 to Hixson and in U.S. Pat. No. 5,484,455 to Kelley. These methods use certain fiber reactive dyes on CD-nylon fibers (cationic dyeable). Since conventional nylon 6 and nylon 66 fibers are cationic, with a high concentration of amine end groups (dye sites), they are readily dyeable by anionic acid dyes. In contrast, CD-nylon fibers are anionic with few amine end groups and thus few dye sites. While CD-nylon has the advantage of exhibiting inherent stainblocking ability as to acid stains, it is not as versatile in accepting dye colors as ordinary nylon.

Fiber reactive dyes are generally used on cotton and exhibit good colorfastness because of covalent bonds between the dye and the cotton. These covalent bonds are more difficult to break than are ionic bonds, which are typically associated with acid dyes on conventional nylon. Attaching fiber reactive dyes through covalent bonds to CD-nylon achieves both the colorfastness and dye resistance needed for a multiple color dyeing process. When fiber reactive dyes are used to dye CD-nylon fibers, and the CD-nylon fibers are later woven with conventional undyed nylon fibers, exposing the predyed CD-nylon fibers later to acid dyes will not dye the CD-nylon fibers.

Although fiber reactive dye methods for CD-nylon allow for the creation of predyed yarns, which later resist taking on acid dyes of a second dye step, the depth of color shades achievable with CD-nylon is limited. CD-nylon has very few amine end groups as compared to ordinary nylon. Since the fiber reactive dyes must attach themselves to these end groups in order to form a covalent bond, it is not possible to build the dye shades to dark and heavy colors. Furthermore, dyed CD-nylon fibers suffer from poor lightfastness, especially in light shades. Where CD-nylon is used as a natural stainblocker, there are also inherent limitations. As disclosed in U.S. Pat. Nos. 5,085,667, 5,199,958, 5,350,426 and 5,466,527 each to Jenkins, some acid and pre-metalized acid dyes will dye CD-nylon as well.

In summary, the problems associated with multiple color dye processes have prevented the use of sequential dye methods to produce multicolored fabrics. Those multicolored dye processes that have been used require large inventories of different yarns and have been limited to a small number of color shades. A need therefore remains for a multiple color dye process whereby woven nylon fabric can be subjected to sequential dyeing operations without dye bleeding or blending during a second dyeing step. A need also remains for a multiple color dye process which allows manufacturers to provide a broad selection of fabrics without having to warehouse large inventories. Accordingly, it is to the provision of such methods that the present invention is primarily directed.

SUMMARY OF THE INVENTION

In a preferred form of the invention a multicolored nylon fabric is produced by weaving nylon fibers dyed with a first anionic dye and treated with a stainblocker with nylon fibers untreated with a stainblocker into a fabric that is then dyed with a second anionic dye of a color different than the color of the first anionic dye. Preferably both dyes are 1,2 metalized complex acid dyes and the stainblocker is a sulfonated novolac polymer.

DETAILED DESCRIPTION

TERMINOLOGY

DYEBATH BLEED TEST PROCEDURE (DBT)

While the colorfastness of dyes on woven fabrics have been measured by standard tests of the American Association of Textile Chemists and Colorists (hereinafter AATCC), there are no standard tests for evaluating colorfastness of dyed fabrics under sequential dyebath conditions, where previously dyed fabrics are subjected to elevated temperatures in the presence of dyebath chemical auxiliaries. Furthermore, under dye bath conditions there are no published colorfastness tests for dye transfer from a previously dyed fiber to an undyed fiber or for dye transfer from a dye solution to a previously dyed fiber. As a consequence, and for the purposes of evaluating test data presented herein, a Dyebath Bleed Test procedure (DBT) was developed which imitates production dyebath conditions. The conditions created in the DBT procedure place dyed fabrics in the presence of undyed fabrics in water, together with acid, nylon leveling agents, wetting agents and other surfactants. The bath is heated at or near boil for three or more hours, with agitation, after which the undyed fabrics are examined for dye transfer. It should be noted that relevant tests disclosed in the Hixson and Kelley Patents lasted for only 30 minutes at elevated temperatures, which is well below actual production dyebath times.

TREATMENT WITH SAC

Sulfonated novolac polymers, also known as sulfonated aromatic aldehyde condensation products (SAC) or syntans, have been used as after treatment agents in nylon dyeing for years. Sulfonated novolac polymers are described in the November 1989 issue of the American Association of Textile Chemists and Colorists journal, *The Textile Chemist and Colorist,* Vol. 21, No. 11, pp.25–30, in an article by Harris and Hangey entitled Stain Resist Chemistry for Nylon 6 Carpet. In nylon apparel type fabrics SACs have been used as fixing agents. Since the mid 1980's SACs have been used as stainblockers on carpets.

Anionic dyed conventional nylon is treated with sulfonated novolac polymers using one of two methods, depending on whether the nylon is dyed by a batch dye method or a continuous dye method. Where nylon is dyed using a batch dye method, the SAC stainblocker is added at a level of between 6–12% OWF either at the end of the batch dye cycle, in a one step dye and fix method, or in a separate treatment step after the batch dye method, referred to as a two step dye and fix method.

Where the continuous dye method is used to dye nylon, the SAC stainblocker and the dye are added together with a thickener and applied to the nylon. The SAC stainblocker is added at a level between 40 to 100 g/l. The nylon is then steamed to set the dye and the stainblocker. In an alternative, the stainblocker is applied to the dyed nylon in a later application step and then the nylon is steamed to set the stainblocker.

In both cases, the SAC stainblocker is added in sufficient quantity to essentially block all the dye sites on the nylon fiber. The SAC stainblocker used for this study was SIMCOFIX DGF-30. This product is available from SIMCO PRODUCTS, INC. of Greenville, S.C., and is used as a nylon fixing agent and as a stainblocker on nylon woven, knits, and piled fabrics.

TESTING METHODS

EXPERIMENT 1

TESTING BATCH DYED NYLON WITH ACID DYES FOR COLORFASTNESS BY THE DBT PROCEDURE

Two sets of 10 gram ordinary nylon yarn skeins were dyed in heavy shades with acid and 1,2 metal complex acid dyes by batch methods at a level from 1.5–3.0% OWF. One set of skeins was used as a control and was tested without the addition of any SAC stainblocker. The other set of skeins was treated with SIMCOFIX DGF-30 at a 10.0% OWF level. All dyed nylon samples were tested for dye transfer by adding a dyed 10 gram nylon skein together with an undyed 10 gram nylon skein at a liquor ratio of 20, together with surfactants and acid in glass jars. The jars were sealed to prevent evaporation and heated to a boil in a heating bath container, where they remained with some agitation for approximately 3 hours. The undyed samples were evaluated for dye transfer from the dyed samples. Where the undyed nylon samples had only a light stain of the original dark shade, then the sample passed (P). Where the undyed nylon sample appeared as a lighter shade of the original dark shade, the sample failed (F). The results are shown in the following Table 1.

TABLE 1

RESULTS OF EXPERIMENT 1 TEST

| Dye* | Type | Unfixed | Fixed |
|---|---|---|---|
| Intralan: | | | |
| Fast Black RB 200% | 1,2 metal acid | P | P |
| Fast Red RB | 1,2 metal acid | P | P |
| Navy SB | 1,2 metal acid | P | P |
| Dark Blue M-BR | 1,2 metal acid | P | P |
| Yellow 2 GL | 1,2 metal acid | P | P |
| Brill Yellow 3GL 200% | 1,2 metal acid | P | P |
| Orange S-R | 1,2 metal acid | P | P |
| Olive S-G | 1,2 metal acid | P | P |
| Bordeaux M-B | 1,2 metal acid | P | P |
| Bordeaux S-BR | 1,2 metal acid | P | P |
| Navy NLF | 1,2 metal acid | P | P |
| Yellow 3RL | 1,2 metal acid | P | P |
| Orange RDL | 1,2 metal acid | P | P |
| Rubine S-2R | 1,2 metal acid | P | P |
| Bordeaux RLB 200% | 1,2 metal acid | P | P |
| Yellow M-3R | 1,2 metal acid | P | P |
| Yellow NW | 1,2 metal acid | P | P |
| Grey SB | 1,2 metal acid | P | P |
| Grey S-BG | 1,2 metal acid | P | P |
| Nylanthrene: | | | |
| Blue GLF | Acid | F | F |
| Brill Blue 2RFF | Acid | F | F |
| Red B 2BSA | Acid | F | F |
| Rubine 5BLF | Acid | F | F |
| Irgalan: | | | |
| Blue 3GL 200% | 1,2 metal acid | P | P |
| Yellow 3RL KWL 250% | 1,2 metal acid | P | P |
| Red 2GL KWL 200% | 1,2 metal acid | P | P |
| Navy B-KWL | 1,2 metal acid | P | P |
| Brown 2RL KWL 200% | 1,2 metal acid | P | P |
| Yellow GRL 200% | 1,2 metal acid | P | P |
| Tectilon: | | | |
| Blue 4RS KWL 200% | Acid | F | F |
| Red 2B 200N | Acid | F | F |
| Blue CT | Acid | F | F |
| Lanasyn: | | | |
| Black BRL SGR 200% | 1,2 metal acid | P | P |
| Bordeaux RL Powder | 1,2 metal acid | P | P |
| Dark Brown S-GL Powder | 1,2 metal acid | P | P |
| Red 2GLN Powder | 1,2 metal acid | P | P |
| Yellow S-2GL Powder | 1,2 metal acid | P | P |
| Ricoamide blue MTR | 1,2 metal acid | P | P |

TABLE 1-continued

RESULTS OF EXPERIMENT 1 TEST

| Dye* | Type | Unfixed | Fixed |
|---|---|---|---|
| Rico red B 200% | 1,2 metal acid | P | P |
| Ricomil violet BLB | acid | F | F |

*The acid dyes in the test include a small sampling of leveling acid and milling acid dyes that are available. The 1,2 metal complex acid dyes are also a small sampling of available dyes. In both cases a range of colors were tested to demonstrate the colorfastness/dye transfer under dyebath conditions (DBT procedure).

Prior to testing, it was expected that all acid dyes would bleed, especially in dark shades, when placed under the DBT procedure, despite improvements in colorfastness observed when tested by standard AATCC colorfastness methods. Regular acid dyes did bleed as expected. Surprisingly, however, test results indicate that when conventional nylon is dyed with 1, 2 metalized complex acid dyes in dark shades, as opposed to regular acid dyes, there is virtually no color bleed under the DBT procedure. Since these dyes are bonded to nylon dye sites by ionic attractions, just as in other acid dyes, it was expected that they would also have colorfastness problems in the same manner as their non metalized counterparts.

Acid dyes such as leveling acids, and to a lesser extent, milling acids, are used to dye most nylon fabrics such as sports wear, swimwear, and carpets. Metalized acid dyes normally have a high resistance to light fading. Consequently, they are used more frequently in special commercial products such as automotive fabrics, where light exposure is excessive. Therefore it would not be logical to begin a colorfastness study with the metalized dyes, since they are not the predominate dye class of choice.

EXPERIMENT 2

TESTING CONTINUOUS DYED NYLON WITH 1,2 METAL COMPLEX ACID DYES USING THE DBT PROCEDURE: MULTICOLOR SPACE DYE

Eight 1.0% dye samples were prepared using 1,2 metalized complex dyes listed in Table 1 together with a wetting agent and a thickener. The color selection included 2 blues, 1 navy, 1 black, 2 reds, 1 yellow, and 1 bordeaux in order to represent a range of colors. Several yarns of conventional nylon were wrapped around a device to form a tight yarn web for dye application. Aliquots of anionic dye were deposited on the web (as part of a multicolored space dye technique) using all eight colors in different locations on the web until most of the web contained dye of one color or another. The device was then placed in a large steam chamber for 10 minutes in order to set the dye on the nylon yarn. After dyeing, the yarns were removed from the device and wrapped into two 10 gram skeins that were then washed and dried. One of the skeins was treated with SIMCOFIX DGF-30 at 10.0% OWF in a separate fix procedure.

RESULTS

The two ten gram skeins were then tested according to the same color bleed test procedure as described in Experiment 1. In both cases, the fixed dyed skeins (or skeins treated with SACs) and unfixed dyed skeins (or untreated with SACs) showed essentially no dye transfer, thus passing the DBT procedure.

EXPERIMENT 3

SOLID COLOR SPACE DYED YARN

The procedure in experiment 2 was repeated except that two ten gram skeins were submerged in a single color 1, 2 metalized complex acid dye solution (as part of a solid color space dye technique). The skeins were then squeezed on a lab padder, steamed for 10 minutes, washed, and dried. The two sets were dyed with one set being treated with SIMCOFIX GF-30 at 10.0% OWF in a separate fixation step.

RESULTS

All samples passed the DBT procedure with dyed skeins showing essentially no dye transfer to undyed skeins.

EXPERIMENT 4

ONE STEP DYEING AND FIXATION

Four conventional nylon skein samples were dyed in the manner described in experiment 2, except that 50 g/l of SIMCOFIX DGF-30 were incorporated into the dye solution together with a wetting agent and thickener. The colors used were blue, yellow, red and black. The samples were rinsed, dried and tested for color transfer.

RESULTS

All samples passed the DBT procedure.

EXPERIMENT 5

MULTIPLE COLOR DYE PROCESS

This study evaluated the resistance of 1, 2 metalized complex dyed nylon, fixed with sulfonated novolac polymers (SACS), to dyes in a subsequent dyeing process. As in experiment 2, two sets (each of two samples) in solid colors of red and yellow were chosen. These sets functioned as controls. One set of samples was batch dyed and fixed, while another was continuous dyed and fixed. In addition a sample of multicolor dyed and fixed was included to make five samples in all. The fixation level was approximately 10.0% OWF using SIMCOFIX DGF-30.

Each ten gram dyed and fixed nylon control sample was placed with an undyed ten gram nylon test sample in a dye vessel. Each vessel contained 300 grams of water, leveling acid blue dye at 0.5% OWF, a wetting agent, and an acid to achieve a pH of 5.5.

The vessels were heated with agitation to approximately 200–205° F. The blue dye bath exhausted onto the nylon test samples after about 20 minutes. The vessel was kept at the elevated temperature for an additional hour before being cooled down. The samples were then rinsed.

RESULTS

The test samples were dyed a medium bright blue as was expected, with no evidence of dye transfer from the dyed control samples. The control samples showed essentially no up-take of blue dye. For example, the red shade remained red and did not turn maroon; the yellow shade remained yellow and did not turn green; and the multicolor samples maintained the same appearance and color when compared to a separate multicolor sample that had not been subjected to sequential dyeing.

EXPERIMENT 6

TESTING BATCH DYED NYLON FOR COLORFASTNESS BY THE DBT PROCEDURE

Two sets of ten gram conventional nylon skeins were dyed and fixed by the procedure of experiment 1 and evaluated for colorfastness. One set was dyed at a 3.0% OWF level, while the other set was dyed at a 0.3% OWF level. The dyes used were non-metalized anionic dyes. The dyes included 1 direct dye, 1 fiber reactive dye, and two regular acid dyes. The results are shown in Table 2 below.

TABLE 2

RESULTS OF EXPERIMENT 6 TEST

| | | DBT Results | |
|---|---|---|---|
| Dye | Type | 3.0% OWF | 0.3% OWF |
| Nylanthrene Blue 2RFF | Acid | F | P |
| Nylanthrene Red B 2BSA | Acid | F | P |
| Dyrite Turq. Blue GRL | Direct | F | P |
| Akreact Blue R | Fiber Reactive | F | P |

OBSERVATIONS FROM EXPERIMENTS

It has been found that a conventional nylon fiber or yarn, predyed with an anionic dye and then treated with a stainblocker, withstands the rigors of the dye bath conditions of a second dyeing operation. Where the predyed and treated yarn is woven into a fabric with undyed conventional nylon fibers or yarn, the resulting fabric can be dyed with an anionic dye without the predyed yarn bleeding or blending with the second dye.

In particular, conventional nylon predyed with a 1, 2 metalized complex acid dye, and then treated with a sulfonated novolac polymer, enables the use of dark color shades on the nylon which will not bleed or blend during a second dyeing operation with anionic dyes. The 1, 2 metalized complex dyes are preferred in this method due to their ability to maintain good colorfastness over a wide range of shade depths (light to dark) when tested according to the DBT test method.

Regular acid dyes, as well as direct and fiber reactive dyes, generally bleed in dark shades and therefore fail the DBT method in dark shades, as shown in Table 2. However, since predyed nylon can include light, medium and dark shades, anionic dyes other than the metalized dyes can be used successfully in this method when used for light and medium shades. For instance, as Table 2 illustrates, for medium shades, direct, fiber reactive and acid dyes will pass the DBT test.

It thus is seen that methods are now provided for dyeing woven, knit, or piled conventional nylon fabrics multiple colors. Where conventional nylon yarn is predyed with 1, 2 metalized complex acid dyes for light to dark shades, or predyed with other acid dyes, direct dyes, or fiber reactive dyes for light to medium shades, and then the yarn is treated with a stainblocker such as a sulfonated novolac polymer, the resulting predyed fabric produced from the yarn is colorfast and dye resistant. As a result, where additional undyed nylon yarn is woven into the fabric, the predyed and treated yarn in the fabric will then withstand the rigors of a second anionic dye operation to dye the undyed nylon yarn, without the risk of dye bleed or absorption of colorants into the predyed portions.

This new multiple color dyeing method allows manufacturers to easily create styling or design effects without having to weave such effects from scratch each time an order is placed. Such processes allow manufacturers to control their carpet inventories whereby a standard color design can be imparted in nylon carpet together with undyed nylon portions, those portions being dyed at a later time in any of a number of shades, as sales orders dictate. Furthermore, the ability of conventional nylon to be dyed a wide array of colors without bleeding or blending in a later dye step, offers advantages to manufacturers that CD-nylon and solution dyed nylon do not. Namely, the range of dye colors and shades now available through this sequential dye method is great.

While this invention has been described in detail with particular reference to the preferred embodiments thereof, it should be understood that many modifications and additions may be made thereto, in addition to those expressly recited, without departure from the spirit and scope of the invention as set forth in the following claims.

I claim:

1. A method of producing a multicolored nylon fabric wherein first conventional nylon fibers dyed with a first anionic dye and treated with a stainblocker are woven with second conventional nylon fibers untreated with a stainblocker into a fabric that is then dyed with a second anionic dye of a color different than the color of the first anionic dye.

2. The method of claim 1 wherein the first conventional nylon fibers dyed with the first anionic dye are woven with undyed second conventional nylon fibers untreated with a stainblocker.

3. The method of claim 1 wherein the first conventional nylon fibers are dyed with a first anionic dye selected from the group consisting of acid, direct, and fiber reactive dyes.

4. The method of claim 3 wherein the first conventional nylon fibers are dyed with a first anionic dye which is a 1, 2 metallized complex acid dye.

5. The method of claim 1 wherein the first dyed conventional nylon fibers are treated with a sulfonated novolac polymer stainblocker.

6. The method of claim 5 wherein the fabric is dyed with a second anionic dye selected from the group consisting of acid, direct, and fiber reactive dyes.

7. The method of claim 6 wherein the fabric is dyed with a second anionic dye which is a 1, 2 metalized complex acid dye.

* * * * *